US006325585B1

(12) United States Patent
Sasaki et al.

(10) Patent No.: US 6,325,585 B1
(45) Date of Patent: Dec. 4, 2001

(54) PERFORATION DEVICE FOR PUNCHING SHEET AT PREDETERMINED POSITIONS AND IMAGE FORMING APPARATUS INCORPORATING THE PERFORATION DEVICE

(75) Inventors: Ichiro Sasaki, Toride; Mitsuo Nimura, Kashiwa, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/253,514

(22) Filed: Feb. 22, 1999

(30) Foreign Application Priority Data

Mar. 11, 1998 (JP) ..... 10-059720

(51) Int. Cl.[7] ..... B26F 1/04; B42C 13/00; B65H 39/10

(52) U.S. Cl. ..... 412/11; 101/485; 270/37; 270/53; 270/58.08; 399/82; 399/407; 412/1; 412/6; 412/9; 412/10; 412/12; 412/14

(58) Field of Search ..... 412/11, 1, 6, 9, 412/10, 12, 14; 270/37, 53, 58.08; 355/324; 399/82, 407; 101/485

(56) References Cited

U.S. PATENT DOCUMENTS 5,383,754 * 1/1995 Sumida et al. ..... 412/11
5,746,162 * 5/1998 Hosoi et al. ..... 270/58.08
6,120,015 * 9/2000 Albright et al. ..... 399/407

* cited by examiner

*Primary Examiner*—A. L. Wellington
*Assistant Examiner*—Mark T. Henderson
(74) *Attorney, Agent, or Firm*—Fitzpatrick, Cella, Harper & Scinto

(57) ABSTRACT

A sheet perforation device for use in an image forming apparatus eliminates inconveniences such as imperfect punching due to too small a sheet size and completion of image formation without notifying the user that the punching could not be performed despite the user's instruction for punching. Punching setup is made and a starting instruction is given through an operating section. Based on the relationship between a selected sheet size and the spacing of holes to be formed by a punching unit, a determination is made as to whether the punching can be correctly performed, and, if it has been determined that the correct punching will fail, a warning message is displayed on the operating section. If the user gives a starting instruction again after recognizing the warning message, image forming operation is started while the punching setup is automatically canceled.

58 Claims, 14 Drawing Sheets

| FIG. 4A |
| --- |
| FIG. 4B |

PERFORATION DEVICE FOR PUNCHING SHEET AT PREDETERMINED POSITIONS AND IMAGE FORMING APPARATUS INCORPORATING THE PERFORATION DEVICE

BACKGROUND OF THE INVENTION

1. Field of the Invention

The present invention relates to a sheet perforation device for forming holes in a sheet by punching at predetermined positions on the sheet.

2. Description of the Related Art

Sheet sorters are known that sort sheets of paper ejected from image forming apparatuses such as copying machines and bind the sheets by means of stapling.

In recent years, sheet sorters have also been proposed of a type having a punching unit which punches holes in successive sheets ejected from an image forming apparatus so as to form holes at predetermined positions in each of the successive sheets. The punching unit is disposed along the path of travel of the ejected sheets so that the sheets are perforated as they move through the punching unit. The pitch, or spacing, of the holes formed by the perforation device is fixed.

The use of this type of punching unit, however, has the following problems. If the punching unit is designed to form two holes, and if the sheet to be perforated has a dimension equal to or less than the spacing between the holes, the sheet is not perforated because the sheet is between the punchers, or the sheet may be imperfectly perforated such that one or both edges of the sheet are notched in a crescent form. Such imperfectly perorated sheets must be discarded. Ejection of a sheet having no perforation at all when the punching function is activated may lead the user to the erroneous conclusion that the punching failure is attributable to a malfunction of the apparatus.

SUMMARY OF THE INVENTION

Accordingly, it is a primary object of the present invention to provide a sheet perforation device which overcomes the above-described problems in the known art.

Another object of the present invention is to provide a sheet perforation device which avoids imperfect punching, thereby avoiding the wasting of sheets.

Still another object of the present invention is to provide a sheet perforation device which is improved so as to avoid any misunderstanding by the user that the punching function has failed due to malfunction.

It is also an object of the present invention to provide an image forming apparatus incorporating the sheet perforating device in accordance with the invention.

To these ends, according to one aspect of the present invention, there is provided a sheet perforation device comprising: punching means for punching holes in a sheet; determining means for determining whether positions of holes to be punched fall within a dimension of the sheet; and warning means for issuing a warning when the determining means has determined that the position of at least one of the holes to be punched falls outside the dimension of the sheet.

In accordance with another aspect of the present invention, there is provided an image forming apparatus comprising: image forming means for forming an image on a sheet; punching means for punching holes in the sheet carrying the image formed by the image forming means; sheet dimension detecting means for detecting a dimension of the sheet; determining means for determining, based on the sheet dimension detected by the sheet dimension detecting means, whether the positions of the holes to be punched fall within the dimension of the sheet; and interrupting means for interrupting the start of an image forming operation of the image forming means.

In accordance with still another aspect of the present invention, there is provided an image forming apparatus comprising: image forming means for forming an image on a sheet; punching means for punching holes in the sheet carrying the image formed by the image forming means; punching setup means for setup of said punching means to enable the punching means to perform a punching operation; sheet dimension detecting means for detecting dimension of the sheet; determining means for determining, based on the sheet dimension detected by the sheet dimension detecting means, whether the positions of the holes to be punched fall within the dimension of the sheet; and setup interrupting means operative in response to an output of the determining means for stopping the punching setup means from performing the setup operation.

Further objects, features and advantages of the present invention will become apparent from the following description of the preferred embodiments with reference to the attached drawings.

DESCRIPTION OF THE PREFERRED EMBODIMENT

Figure 1:
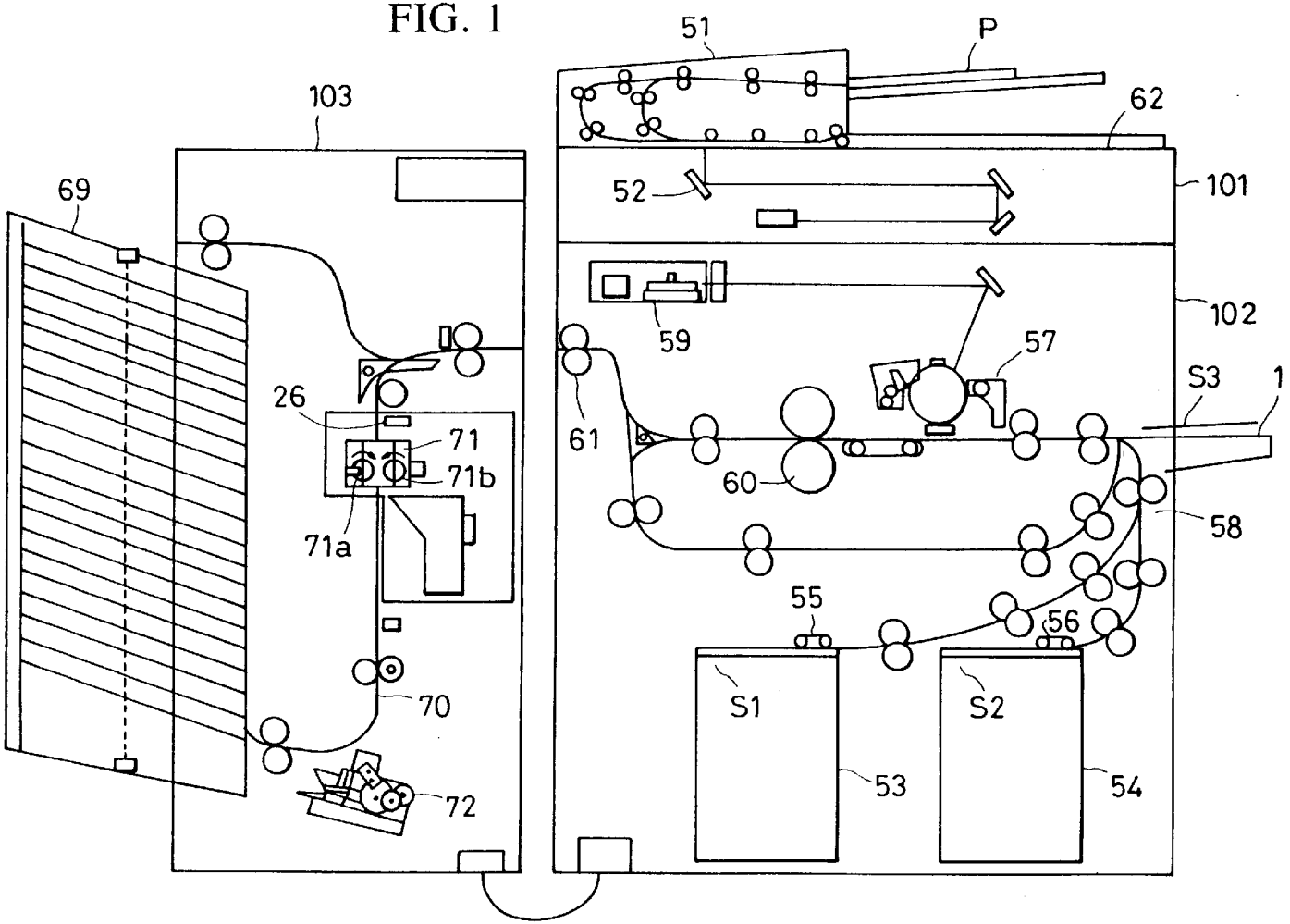
FIG. 1 is a sectional view of an image forming apparatus embodying the present invention.

Referring to FIG. 1, an image forming apparatus embodying the present invention has an original reading section 101, an image forming section 102, and a sheet sorting section 103. The original reading section 101 includes an automatic original feeder unit 51 that feeds an original sheet P set on the apparatus to an original reading position and then conveys the original to an eject position, and an optical system 52 that scans and reads the original set in the original reading position.

The image forming section includes the following parts or units: sheet storage units 53 and 54 carrying stacks of sheets S1 and S2 of paper of different sheet sizes; sheet feeder units 55 and 56 for feeding the sheets; a manual feeder unit 1 carrying a stack of sheets S3 to be fed manually; an image forming unit 57 that performs a series of image forming operations including formation of a toner image on a pho tosensitive member and transfer of the toner image from the photosensitive member to a sheet; a sheet path 58 along which the sheet is fed into the image forming unit 57; a laser scanner 59 which scans the photosensitive member with a laser beam in accordance with image information read by the optical system 52, thereby forming an electrostatic latent image on the photosensitive member; a fixing unit 60 which melts the toner on the sheet to fix the toner image to the sheet; a sheet conveyor 61 for conveying the sheet carrying the fixed image to the sheet sorting section 103; and an operating panel unit 62 that enables a user to setup and confirm various conditions of operations to be performed by the image forming section 102 and the sheet sorting section 103.

Figure 2:
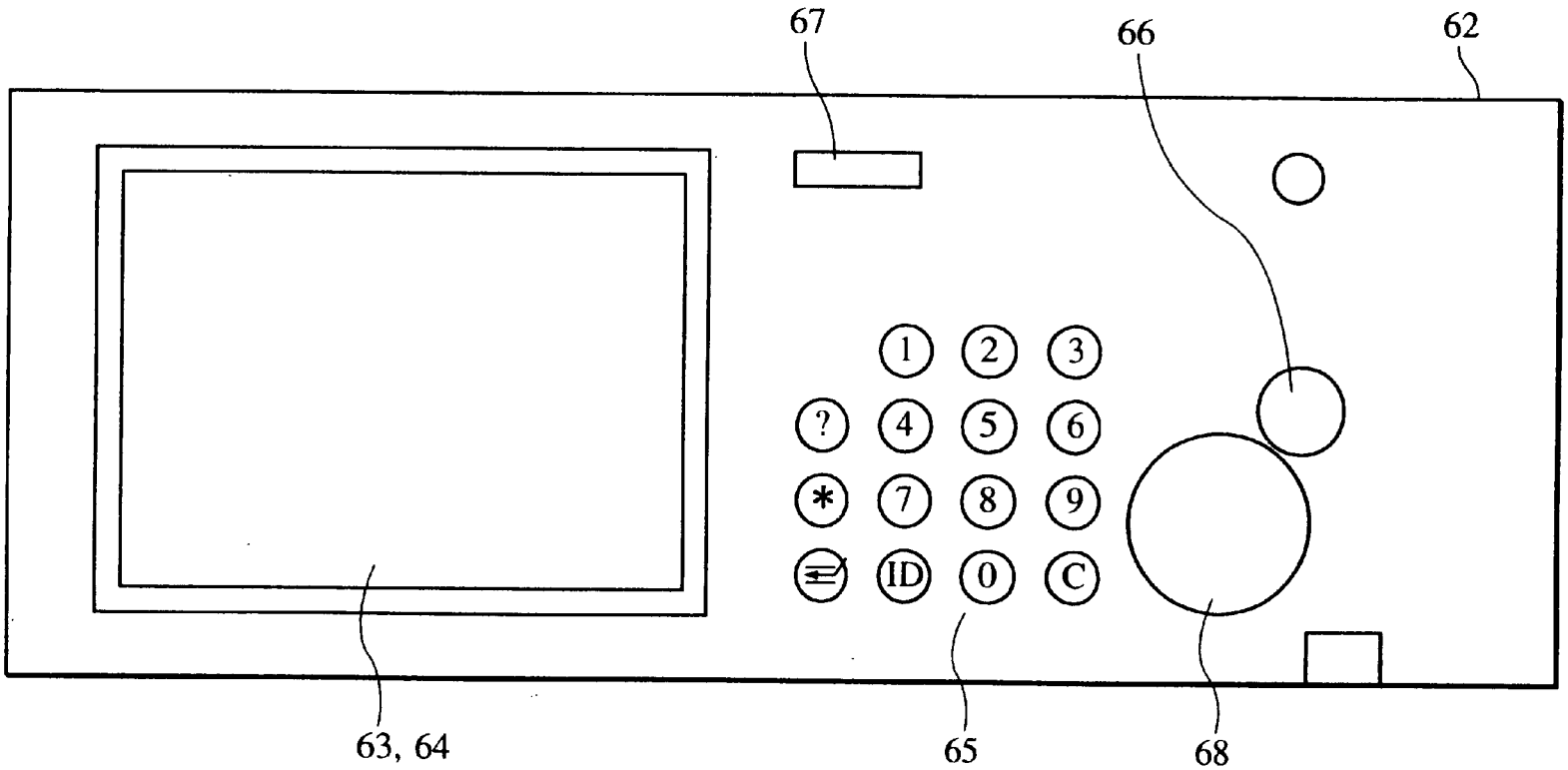
FIG. 2 is a top plan view of an operating panel of the image forming apparatus.

Referring now to FIG. 2, the operating panel unit 62 has the following parts or devices: a display device 63 which displays various types of information such as shown in FIGS. 5 to 11 to enable the user to confirm the operating conditions set on the apparatus; a touch panel key device 64 overlain by the display device 63 and adapted to be operated by the user to setup details of the conditions of the image forming operation, as well as the conditions of operation of the sheet sorting section; a ten-key device 65 that enables setting of numerical conditions such as the number of copies to be formed; a stop key 66 which when pressed stops the image forming operation; a reset key 67 for initializing the operating conditions; and a start key 68 which when pressed triggers the image forming operation.

Referring back to FIG. 1, the sheet sorting section 103 includes the following units: a bin unit 69 that sorts the sheets and carries stacks of the sorted sheets; a sheet conveyor unit 70 that conveys the sheets coming from the image forming section 102 towards the bin unit 69; a punching unit 71 that punches holes along a trailing end edge of the sheet which is being conveyed by the sheet conveyor unit 70; and a stapling unit 72 that binds each stack of the sorted sheets by means of stapling.

Figure 12A:
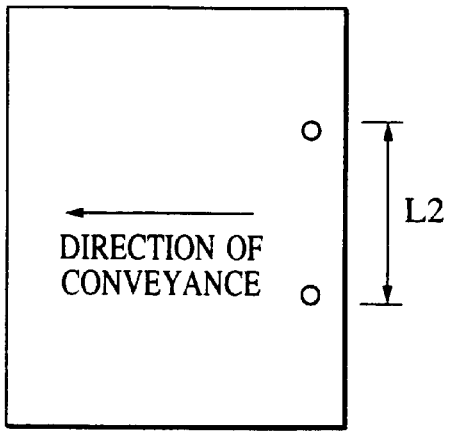
FIGS. 12A to 12D are illustrations of sheets showing the dimensions of the sheets that permit two-hole and three-hole punching.
Figure 12B:
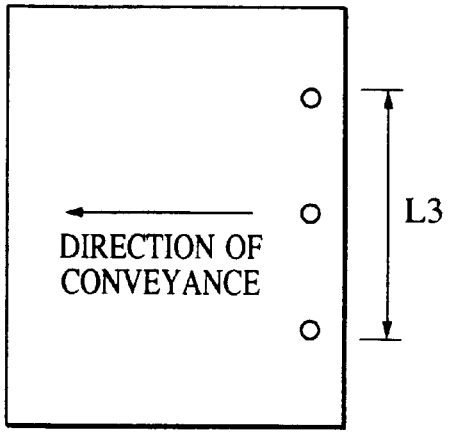
Figure 12C:
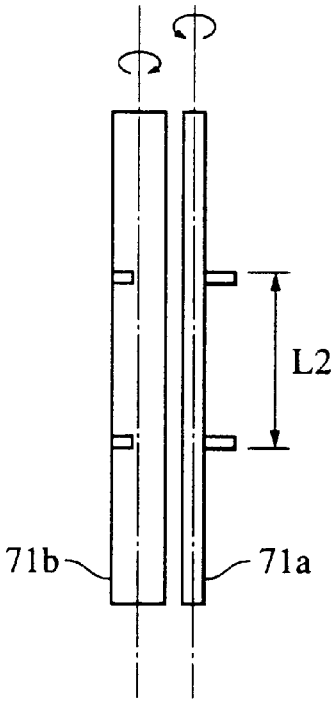
Figure 12D:
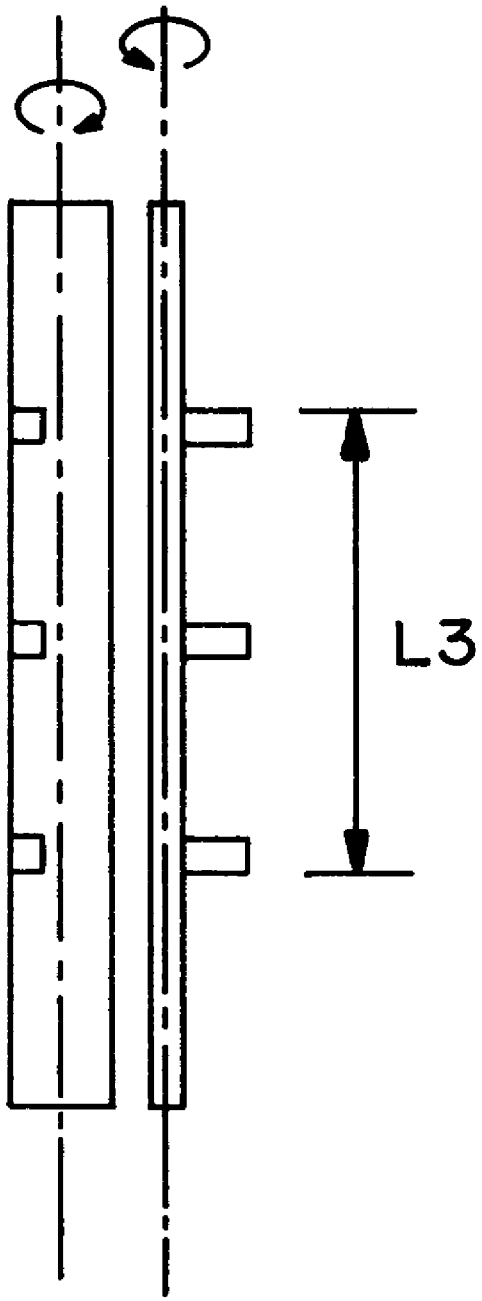

FIG. 12C shows, by way of example, the punching unit 71 which in this case is designed to form two holes. The punching unit 71 has a pair of rotary punching members 71*a* and 71*b* arranged to rotate in opposite directions as indicated by arrows. Holes are punched out in the sheet along a line which is perpendicular to the direction of movement of the sheet. Two types of punching units: namely, a duplex punching unit exclusively used for forming two holes and, as illustrated in FIG. 12D, a triplet punching unit exclusively used for forming three holes, are available, and only one of these two types of punching unit is mounted in the sheet sorting section 103. In each type of punching unit, the spacing, or the pitch, of the punches is fixed, so that the spacing, or the pitch, of the holes is correspondingly fixed. In practice, two types of sorting section, one incorporating the duplex punching unit and the other incorporating the triplet punching unit, are available for selection by the user. One of these two types of sorting section is selected and coupled to the image forming section when the image forming apparatus is installed, in accordance with the request of the user.

In operation, the user sets an original in the original reading section 101 and sets various conditions for image formation by means of the touch panel key device 64 and the ten-key device 65. The user then presses the start key 68 to start the image forming operation. While the original is being read in the original reading section 101, the sheet feed operation is started in the image forming section 102 so that a sheet is fed from the sheet storage unit 53 or 54 in accordance with the condition set by the user or from the manual sheet feeder unit 1. The sheet is fed into the image forming unit 57 through the sheet feed path. Parameters of the sorting operation set by the user through the operating panel unit 62 are sent to the sheet sorting section 103, so that the sheet sorting operation is commenced when a sorting start signal is delivered to the sheet sorting section 103. The image forming unit 57 forms a toner image in accordance with the image information read by the original reading section 101. The toner image thus formed is transferred to the sheet which then passes through the fixing unit 60, whereby the toner image is fixed. Finally, the sheet sorting section performs sorting, punching and stapling, whereby product documents are obtained.

Figure 3:
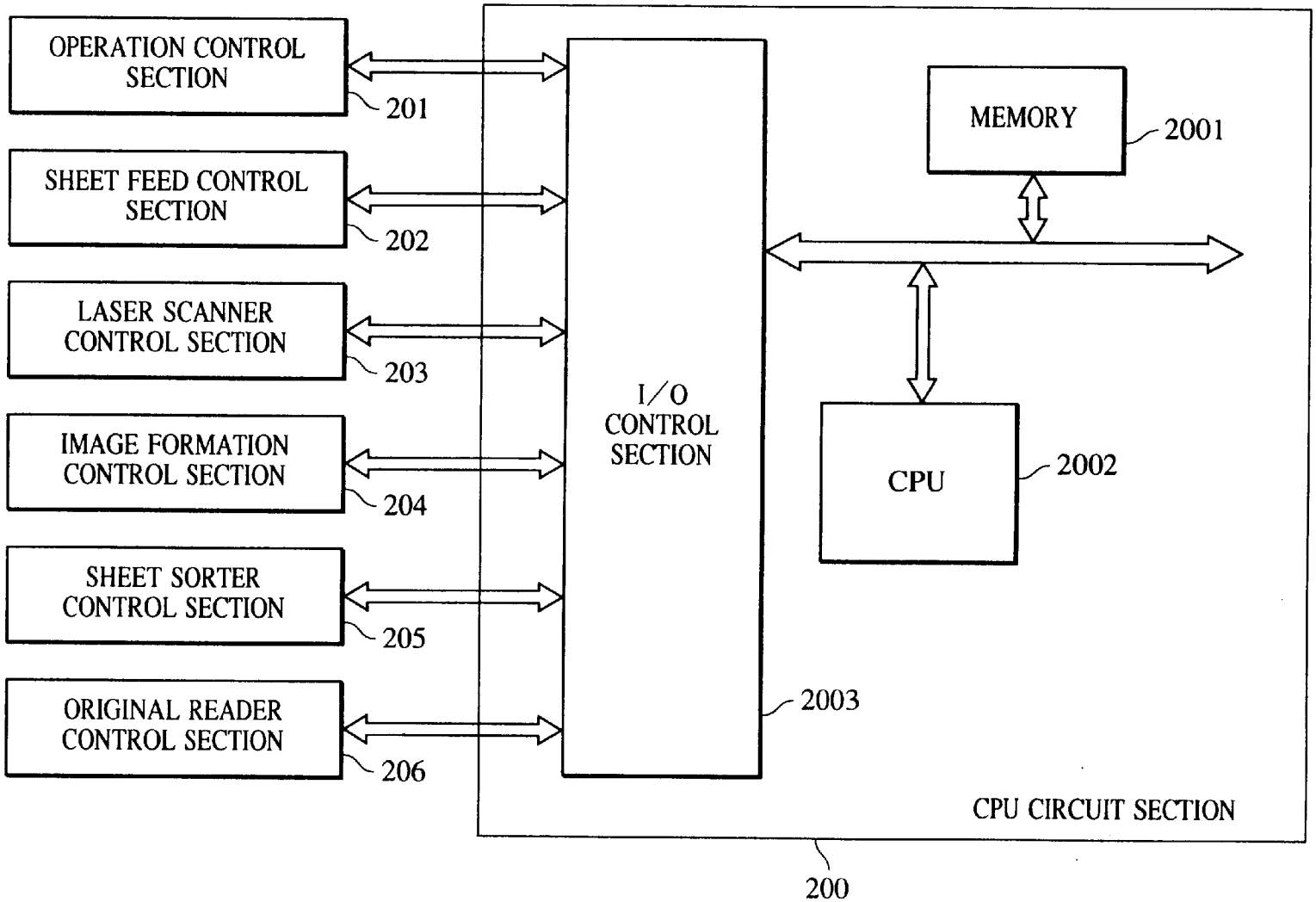
FIG. 3 is a block diagram showing the construction of the image forming apparatus.

Referring to FIG. 3 which is a block diagram showing the construction of the image forming apparatus, a CPU circuit 200 includes a central processing unit (referred to as the "CPU" hereinafter) 2002 that performs overall control of the image forming apparatus in accordance with predetermined programs. The programs are stored in a ROM. Other types of storage means are also used such as a RAM for temporarily storing data under processing, an IC card, a floppy disk, etc. These storage devices and media are collectively referred to as a "memory" and generally denoted by 2001. The memory 2001 constitutes part of the CPU circuit 200. The CPU circuit 200 further includes an I/O control section 2003 that controls various input and output signals. The memory 2001 and the I/O control section are governed by control signals produced by the CPU 2002. Various control sections including an operation control section 201, a sheet feed control section 202, a laser scanner control section 203, an image formation control section 204, a sheet sorter control section 205, and an original reader control section 206 are under the control of the CPU circuit 200.

Figure 5:
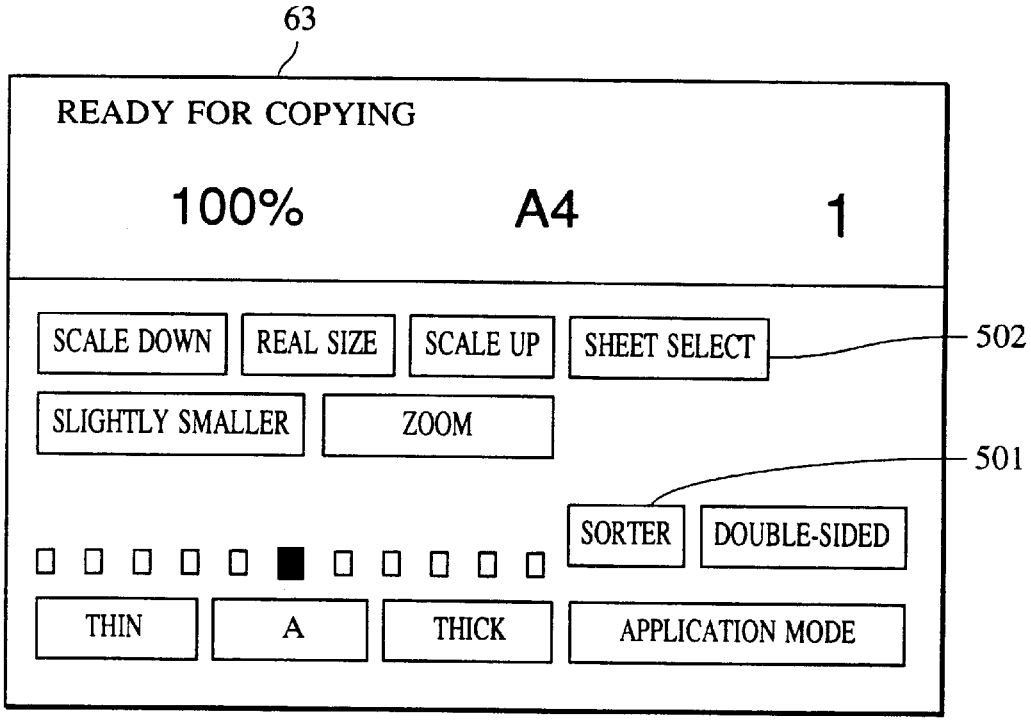
FIGS. 5 to 11 are illustrations of the operating panel showing messages and information displayed thereon.
Figure 6:
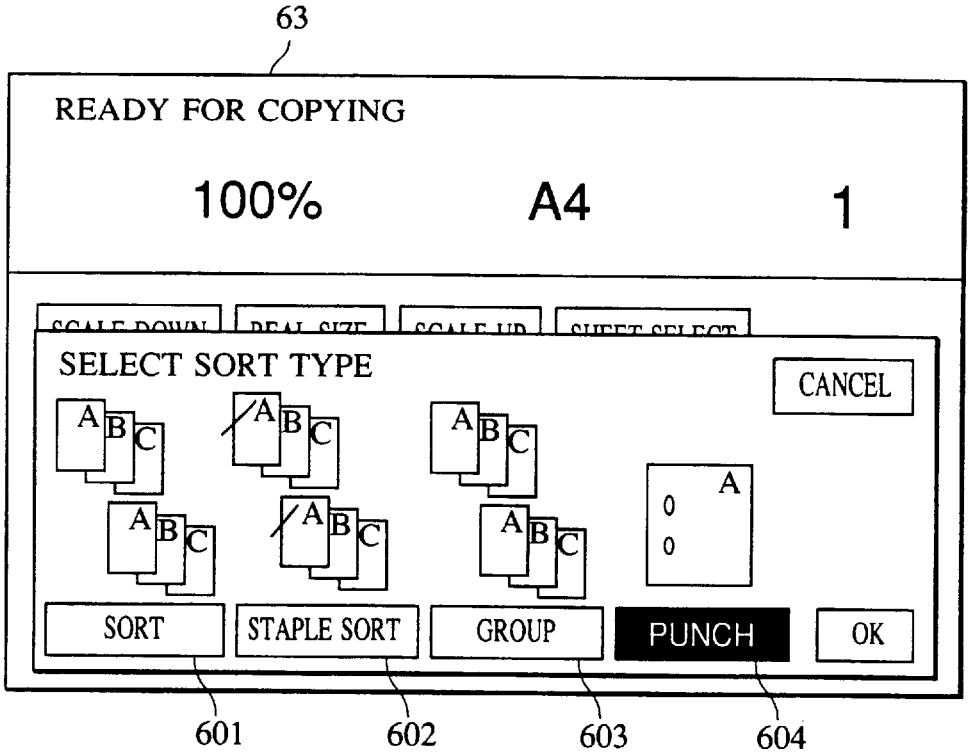

FIG. 5 shows the display device 63 and the touch panel key device 64 in a standard state ready for the setup of copying operation. The punching operation and the sheet selecting operation are set up in accordance with the following procedures. Referring first to the punching operation, a touch on a SORTER key 501 by a user's finger causes the display device 63 to change the contents of the display from those shown in FIG. 5 to those shown in FIG. 6. In FIG. 6, various keys are displayed such as a SORT key 601, a STAPLE SORT key 602, a GROUP key 603, and a PUNCH key 604. The PUNCH key 604 darkens when touched, thus indicating that punching operation has been set up.

Figure 7:
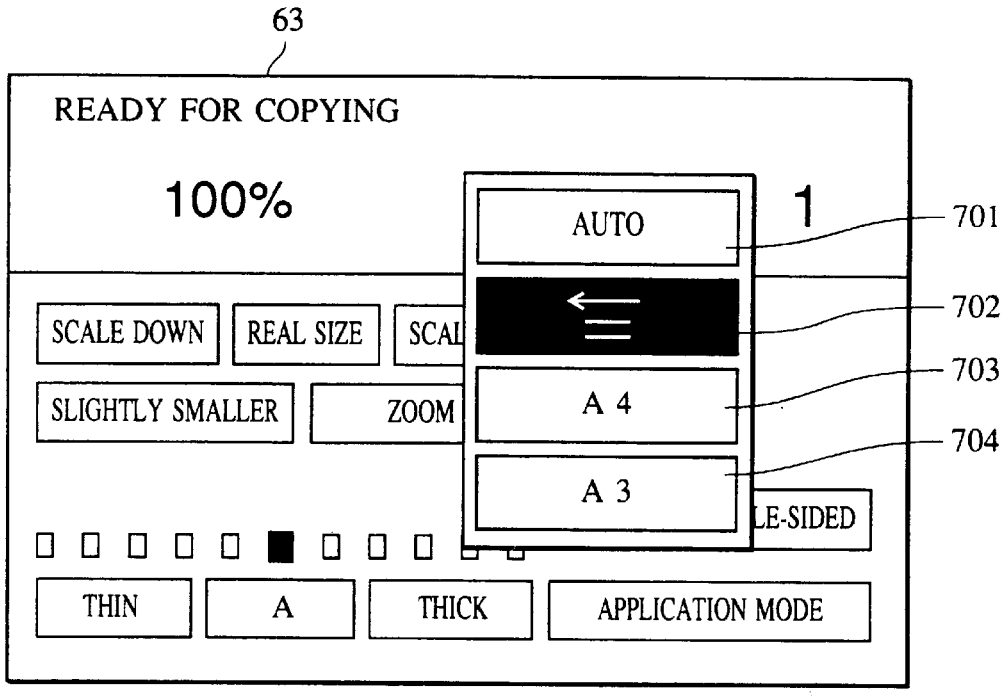

Referring back to FIG. 5, a touch on the SHEET SELECT key 502 causes the display device 63 to change the contents of the display from those shown in FIG. 5 to those shown in FIG. 7. In FIG. 7, various keys are displayed such as an AUTO key 701, which when touched triggers an automatic sheet selection mode to automatically select the sheet storage unit holding the sheets of an optimum size based on the size of the original, magnification factor, and other conditions. A manual feed key 702 represented by an arrow mark "⇐" is touched when the user wishes to manually feed a sheet. An A4 key 703 indicates that A4-size sheets are stored in the sheet storage unit 53, and when touched, selects a mode which feeds A4-size sheets from the sheet storage unit 53. An A3 key 704 indicates that A3-size sheets are stored in the sheet storage unit 54, and when touched, selects a mode which feeds A3-size sheets from the sheet storage unit 54. The manual feed "⇐" key 702 darkens when touched, thus indicating that the sheets in the manual sheet feeder unit 1 have been selected.

The manual sheet feeder unit 1 is designed to permit the user to use a variety of sizes of sheets, and does not have any sensing means for detecting the size of the sheet. In contrast, each of the sheet storage units 53 and 54 has a switch (not shown) serving as a sheet size detecting means that detects the size of the sheet stored therein. The sheet size detecting means, however, may be implemented by using, in place of the switch, variable resistors operatively associated with sheet guides that detect the length and the width of the sheets. Alternatively, the sheet storage unit 53 and the sheet storage unit 54 are used exclusively for the A4-size sheets and for the A3-size sheets, respectively, and information concerning such exclusive use is stored in the memory 2001, so that the sheet size is discriminated based on the sheet storage unit.

Figures 4, 4A:
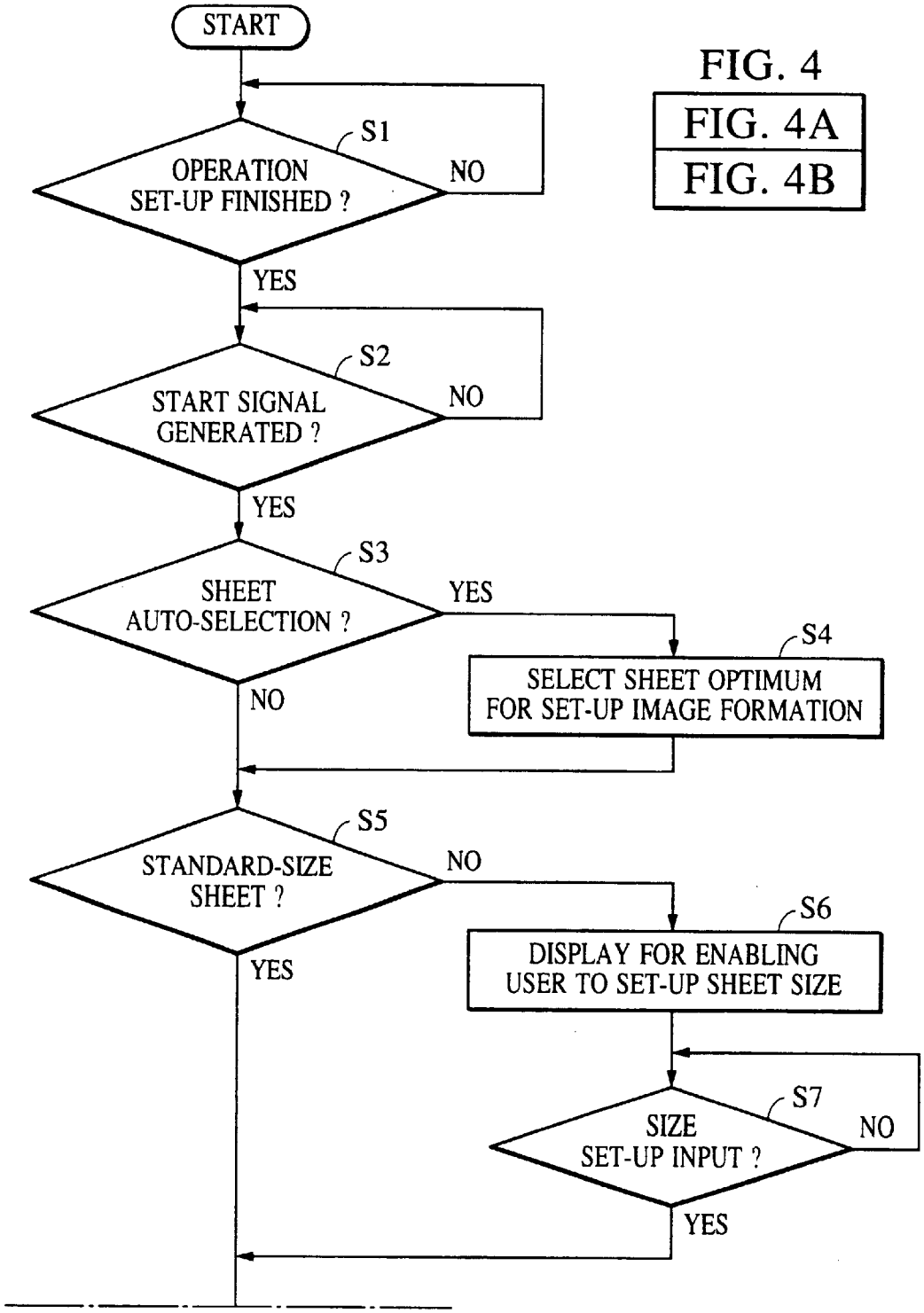
FIG. 4, which is formed of FIGS. 4A and 4B, is a flowchart showing a process of control performed in the image forming apparatus.
Figure 4B:
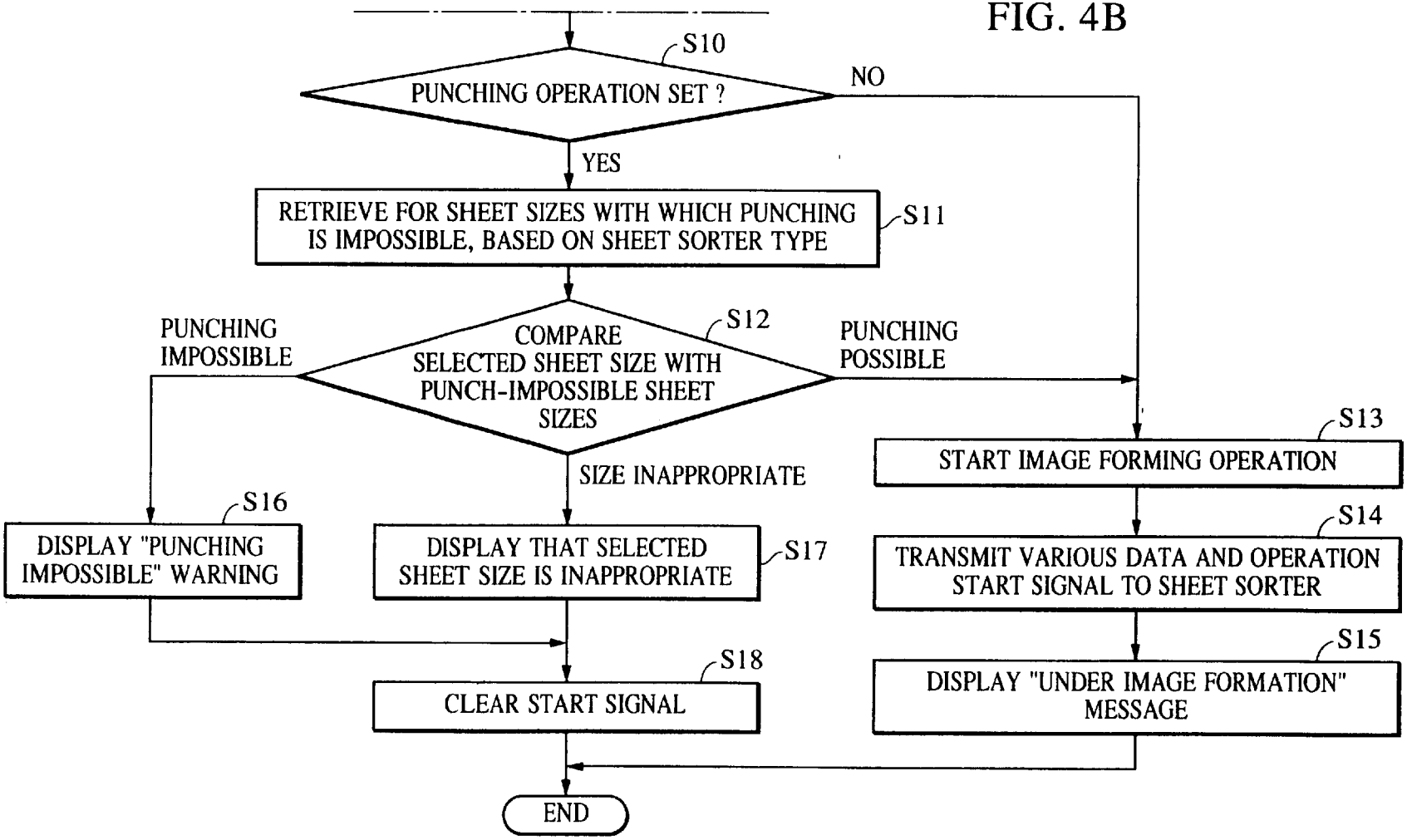

FIG. 4 is a flowchart showing a process of control performed in the image forming apparatus of this embodiment.

Step S1 waits for completion of the setup operation to be performed by the image forming section and the sheet sorting section, e.g., setup such as one of those shown in FIGS. 5 to 11. If the operation setup has been finished, the process advances to Step S2 which waits for generation of an image formation start signal. The image formation start signal is generated when the user presses the start key 68 on the operating panel unit 62, so that the process advances to Step S3 which determines whether the automatic sheet selection mode has been selected. If this mode has been selected, i.e., if the AUTO key 701 shown in FIG. 7 has been touched, the process advances to Step S4, otherwise the process skips to Step S5, having determined that one of the manual feed key "⇐" 702, A4 key 703 and A3 key 704 of FIG. 7 has been touched.

Figure 9:
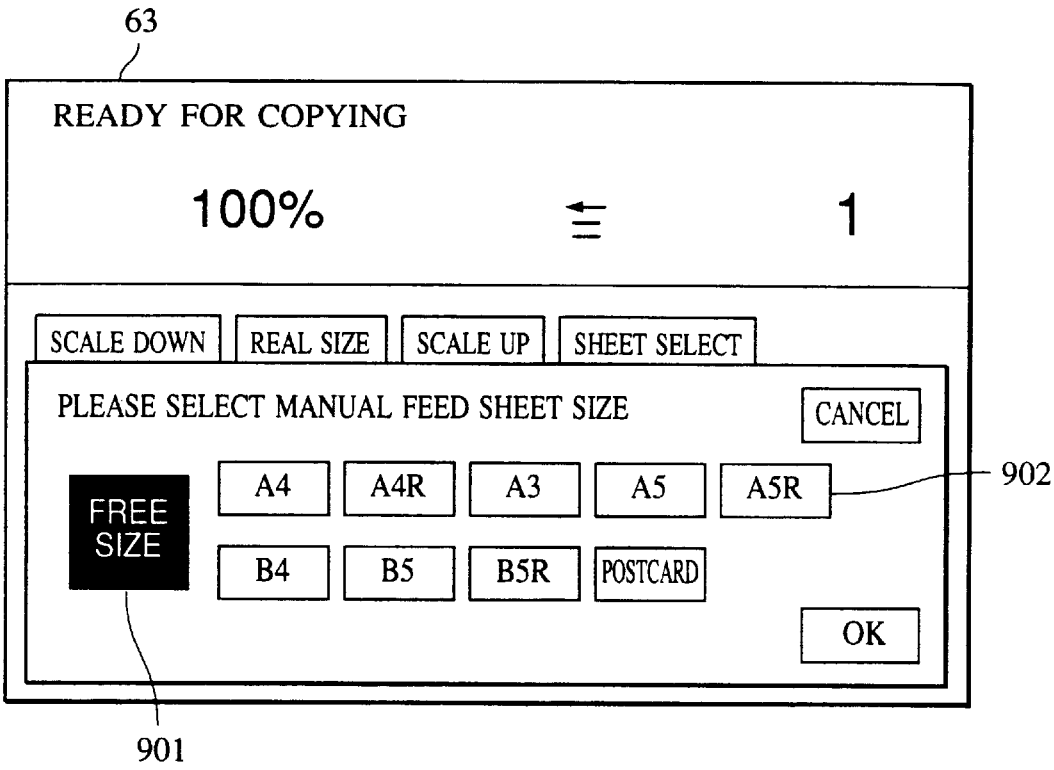
Figure 10:
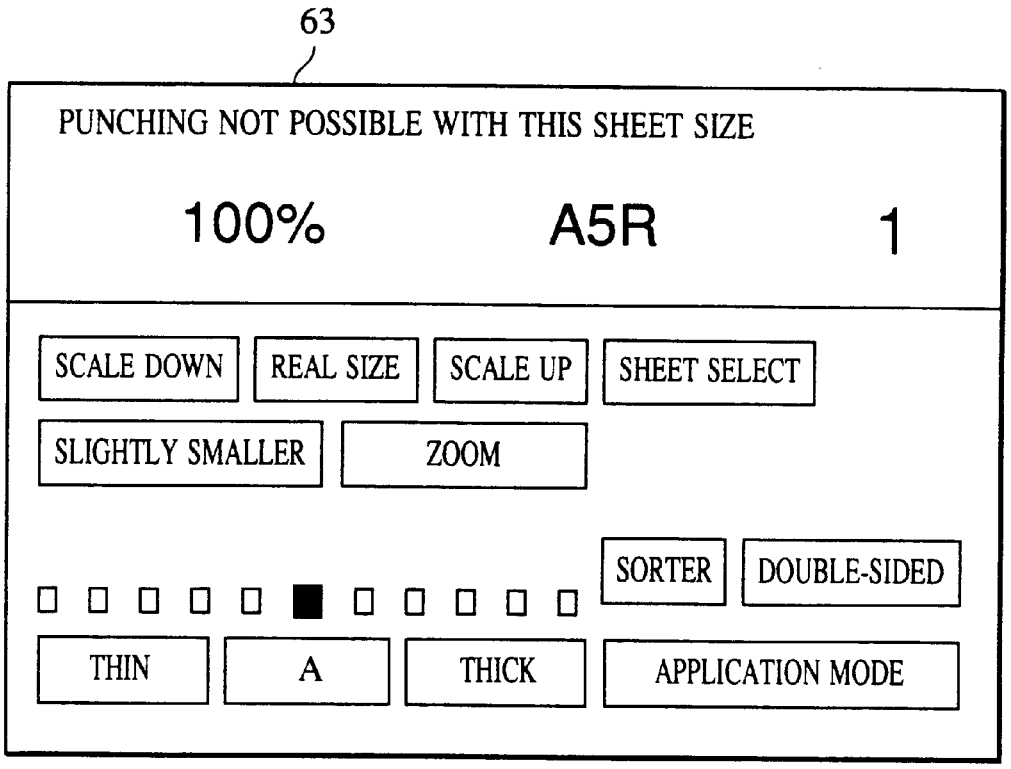
Figure 11:
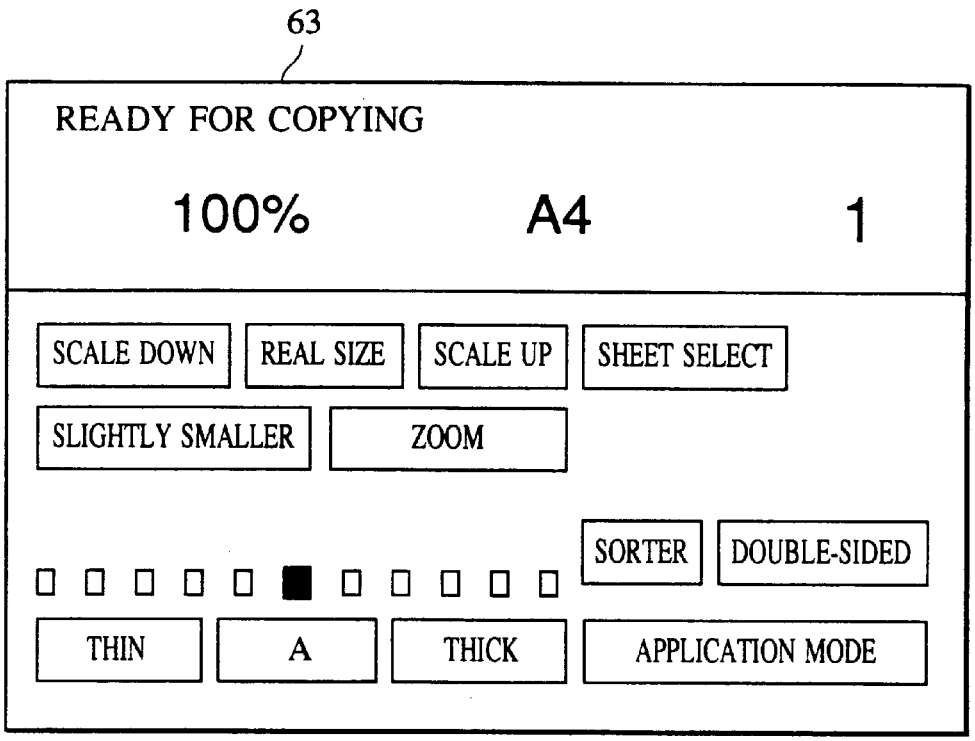

In Step S4, one of the sheet storage units that stores sheets of a size optimum for the image formation is selected based on the original size information derived from the automatic original feeder unit 51 and from magnification information. Step S5 determines whether the selected sheet is of a standard size. If the answer is "YES", the process skips to Step S10. If the answer is "NO", i.e., if a FREE SIZE key 901 has been touched in the manual sheet feed mode as shown in FIG. 9, the process advances to Step S6 which requests the user to select the sheet size. To this end, the display device 63 displays the contents as shown in FIG. 9 once again. Thus, a subsequent step S7 waits for the size setup input which is given by the user by touching one of standard-size sheet keys such as A4, A4R, B4 and so forth appearing on the display shown in FIG. 9, whereby the sheet size is determined.

Step S10 determines whether the setup for the punching operation has been made. If the answer is "NO", i.e., if the punching operation has not been requested, the image forming operation is executed in Steps S13, S14 and S15, whereas, if the punching operation has been requested, the process advances to Step S11. Step S11 discriminates the type of the sheet sorting section 103, i.e., whether the sheet sorting section 103 employs a duplex punching unit for forming two holes or a triplet punching unit for forming three holes, based on information transmitted from the sheet sorting section 103. Step S11 then retrieves sheet sizes that do not permit punching by the sheet sorting section 103. Namely, if the sheet sorting section 103 is of the type that employs a duplex punching unit, Step S11 retrieves sheet sizes that are not large enough to permit punching of two holes, whereas, if the sheet sorting section 103 is of the type that employs a triplet punching unit, sheet sizes that are not large enough to permit formation of three holes are retrieved.

FIGS. 12A and 12B show the positions of holes formed by the duplex punching unit and the triplet punching unit, respectively. It will be seen that the distance L3 between the outermost ones of three holes shown in FIG. 12B is greater than the spacing L2 between two holes shown in FIG. 12A. Thus, whether the sheets can be correctly perforated depends on the type of the sheet sorting section 103, i.e., depending on whether the duplex or triplet punching unit is used. When the sheet sorting section 103 is of the type that employs the duplex punching unit for forming two holes, sheets having dimensions not greater than L2 are determined as being sheets that cannot be correctly perforated. Similarly, when the sheet sorting section 103 employs the triplet punching unit for forming three holes, sheets having dimensions not greater than L3 are determined as being sheets that cannot be correctly punched.

The illustrated embodiment employs a control process in which sheet sizes that do not permit correct punching are retrieved based on the result of a determination which is made by the image forming section 102 based on the information identifying the type of the sheet sorting section 103. This, however, is not exclusive and the arrangement may be such that information concerning the sheet sizes that do not permit correct punching is generated in the sheet sorting section 103 and delivered to the image forming section 102. It is also possible to provide that information concerning the size of the sheet selected in the image forming section 102 is sent to the sheet sorting section 103 which then determines whether the correct punching is possible and sends the result of the determination back to the image forming section 102.

Figure 8:
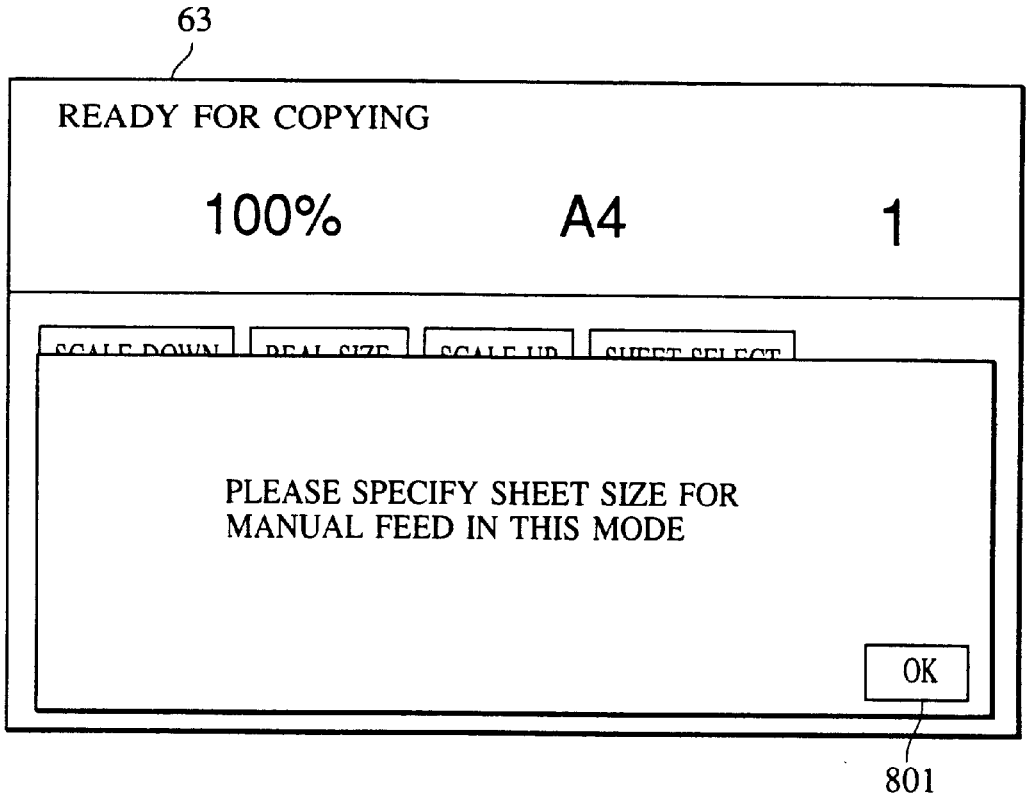

In Step S12, a comparison is made between the size of the selected sheet and the sheet sizes with which correct punching is impossible. If it is determined as the result of the comparison that the punching can be performed safely, the process advances to Step S13 to start the image forming operation. In Step S14, data necessary for the sorting operation and an operation start signal are transferred to the sheet sorting section 103. In Step S15, a message reading "UNDER COPYING" (see FIG. 11) is displayed on the display device 63. In contrast, if the comparison executed in Step S12 has proved that the punching cannot be safely performed, the process advances to Step S16 which issues a "punching impossible" warning by causing the display device 63 to display a message reading "PUNCHING IMPOSSIBLE WITH THIS SHEET SIZE" (See FIG. 10). The process then advances to Step S18 which invalidates the start signal to prevent the image forming operation from starting. Step S17 is executed following Step S12 if the comparison executed in Step S12 has shown that the sheet size is not appropriate. This occurs when the manual sheet feed mode has been selected without designation of the manually-fed sheet, or when the FREE SIZE instruction is given again in Step S7. Step S17 gives a warning indicating that the setup of the sheet size is inappropriate for the punching by causing the display device 63 to display a message reading "PLEASE SPECIFY SHEET SIZE FOR MANUAL FEED IN THIS MODE" (See FIG. 8). When an OK key 801 shown in FIG. 8 is touched, Step S18 is executed to invalidate the start signal.

Thus, the start signal is invalidated in Step S18 in the case where the punching is impossible or the sheet size is inappropriate. However, if the user again presses the start key on the operating touch panel unit, a new start signal is generated to commence the image forming operation, after the setup for the punching operation is automatically canceled by the image forming section 102.

The arrangement may be such that the manual-feed sheet-size selecting screen as shown in FIG. 9 appears when the OK key 801 is touched on the display in Step S17, so as to enable the user to select and specify the sheet size, followed by execution of Step S12.

In the described embodiment, the apparatus is programmed so that a determination of whether punching is possible is made after the receipt of the start signal. The process, however, may be such that, if determination of the sheet size to be used in the image formation is allowed during the setting of the conditions of image forming processing in Step S1, determination as to whether the punching is possible is made prior to the generation of the start signal. If it is determined that the punching is impossible, the display of the PUNCH key 604 is changed into a gray color tone to prohibit the punching setup through this key.

As will be understood from the foregoing description, according to the present invention, a determination is made as to whether the positions of holes to be punched in the sheet by the punching means falls within the dimension of the sheet, and a warning is issued when the punching positions do not fall within this dimension. The user therefore can be informed of the risk that the punching may fail, in advance of the image forming operation.

It is also to be appreciated that wasting of sheets due to defective punching is avoided because the start of the image forming operation is interrupted when it has been determined based on the sheet size that the punching positions do not fall within the dimension of the sheet.

In addition, the operation for setup to effect punching through the setting means is interrupted when it has been determined based on the sheet size that the punching positions do not fall within the dimension of the sheet. The user can therefore be informed of the fact that the punching is impossible, thus avoiding risk of production of defective sheets.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus, comprising:

image forming means for forming an image on a sheet;

punching means for punching holes in the sheet carrying the image formed by said image forming means;

sheet dimension detecting means for detecting a dimension of said sheet;

determining means for determining, based on the sheet dimension detected by said sheet dimension detecting means and on a distance between outermost holes of a row of holes to be punched by said punching means, whether positions of the holes to be punched fall within the dimension of said sheet; and interrupting means for interrupting a start of an image forming operation of said image forming means when said determining means determines that the positions of the holes to be punched fall outside of the dimension of said sheet.

2. An image forming apparatus according to claim 1, further comprising:

punching setup means for setup of said punching means to perform punching operation; and setup interrupting means for disabling said punching setup means to cancel the setup and for allowing said image forming means to start the image forming operation when an image forming instruction is received after said interrupting means has interrupted the start of the image forming operation.

3. An image forming apparatus according to claim 1, wherein said punching means comprises one of a duplex puncher capable of punching two holes and a triplet puncher capable of punching three holes, a distance between outermost holes to be punched by said triplet puncher being different from a distance between the two holes to be punched by said duplex puncher, and wherein said determining means performs a determination in accordance with a signal received from said punching means and indicating whether said punching means comprises the duplex puncher or the triplet puncher.

4. An image forming apparatus according to claim 1, wherein said determining means performs a determination based on a signal received from said punching means and indicating a minimum dimension of a sheet that permits punching.

5. An image forming apparatus according to claim 1, wherein said determining means performs a determination in accordance with manually-input sheet size information.

6. An image forming apparatus, comprising:

image forming means for forming an image on a sheet;

punching means for punching holes in the sheet carrying the image formed by said image forming means;

punching setup means for setup of said punching means to enable said punching means to perform a punching operation;

sheet dimension detecting means for detecting a dimension of said sheet;

determining means for determining, based on the sheet dimension detected by said sheet dimension detecting means and on a distance between outermost holes of a row of holes to be punched by said punching means, whether positions of the holes to be punched fall outside of the dimension of said sheet; and setup inhibiting means operative in response to an output of said determining means for inhibiting said punching setup means from performing a setup operation when said determining means determines that the positions of the holes to be punched fall within the dimension of said sheet.

7. An image forming apparatus, comprising:

image forming means for forming an image on a sheet;

punching means for punching the sheet carrying the image formed by said image forming means;

sheet dimension detecting means for detecting a dimension of the sheet;

determining means for determining, based on the sheet dimension detected by said sheet dimension detecting means and on a distance between outermost holes of a row of holes to be punched by said punching means, whether positions of the holes to be punched fall within the dimension of said sheet; and warning means for issuing a warning when said determining means has determined that the position of at least one of the holes to be punched falls outside the dimension of said sheet.

8. An image forming apparatus according to claim 7, wherein said determining means performs a determination based on a nominal size of the sheet.

9. An image forming apparatus according to claim 7, wherein said determining means performs a determination based on the number of holes to be punched by said punching means.

10. An image forming apparatus according to claim 7, wherein said punching means comprises one of a duplex puncher capable of punching two holes and a triplet puncher capable of punching three holes, and wherein a distance between outermost holes to be punched by said triplet puncher is different from a distance between the two holes to be punched by said duplex puncher.

11. An image forming apparatus according to claim 7, further comprising:

control means for controlling said punching means, said controlling means operative in response to an output from said determining means so as to prohibit said punching means from performing punching when said determining means has determined that the positions of the holes to be punched do not fall within the dimension of said sheet.

12. An image forming apparatus, comprising:

image forming unit for forming an image on a sheet;

a puncher for punching the sheet carrying the image formed by said image forming unit;

a first size detector for detecting a size of sheet to be punched by said puncher;

a second size detector for detecting a size of sheet unable to be punched appropriately by said puncher; and an alarm for indicating an alarm when the size detected by said first size detector corresponds to the size detected by said second size detector.

13. An image forming apparatus according to claim 12, further comprising:

a first instruction input terminal for inputting a first instruction for an image forming operation of said image forming unit; and an invalidator for invalidating the first instruction inputted from said first instruction input terminal when the size detected by said first size detector corresponds to the size detected by said second size detector, wherein said image forming unit forms an image in accordance with the first instruction unless said invalidator invalidates the instruction.

14. An image forming apparatus according to claim 12, wherein said alarm is indicated when the size detected by said first size detector is unknown.

15. An image forming apparatus according to claim 12, wherein said second size detector detects the size based on information of said puncher.

16. An image forming apparatus according to claim 13, wherein said invalidator does not invalidate the first instruction secondarily inputted from said first instruction input terminal even if the size detected by said first size detector corresponds to the size detected by said second size detector.

17. An image forming apparatus according to claim 16, further comprising:

second instruction input terminal for inputting a second instruction for a punching operation of said puncher, wherein said puncher punches the sheet in accordance with the second instruction and said invalidator invalidates the second instruction when said image forming unit starts an image forming operation in accordance with the first instruction secondarily inputted from first instruction input terminal.

18. An image forming apparatus according to claim 14, further comprising:

an instruction input terminal for inputting an instruction for an image forming operation of said image forming unit; and an invalidator for invalidating the instruction inputted from said instruction input terminal when the size detected by said first size detector is unknown, wherein said image forming unit forms an image in accordance with the instruction unless said invalidator invalidates the instructions.

19. An image forming apparatus according to claim 18, wherein said invalidator does not invalidate the instruction secondarily inputted from said instruction input terminal even if the size detected by said first size detector is unknown.

20. An image forming apparatus, comprising:

an image forming unit for forming an image on a sheet;

a puncher for punching the sheet carrying the image formed by said image forming unit;

a first size detector for detecting a size of sheet to be punched by said puncher;

a second size detector for detecting a size of sheet which is not able to be punched appropriately by said puncher;

an instruction input terminal for inputting an instruction for an image forming operation of said image forming unit; and an invalidator for invalidating the instruction inputted and from said instruction input terminal when the size detected by said first size detector corresponds to the size detected by said second size detector, wherein said image forming unit forms an image in accordance with the instruction unless said invalidator invalidates the instruction.

21. An image forming apparatus, comprising:

image forming unit for forming an image on a sheet;

puncher for punching the sheet carrying the image formed by said image forming unit;

first size detector for detecting a size of sheet which is not able to be punched appropriately by said puncher;

instruction input terminal for inputting an instruction for a punching operation of said puncher; and invalidator for invalidating the instruction inputted from said instruction input terminal when the size detected by said first size detector corresponds to the size detected by said second size detector.

22. An image forming apparatus, comprising:

an image forming unit for forming an image on a sheet;

a puncher for punching the sheet carrying the image formed by said image forming unit;

a first size detector for detecting a size of sheet to be punched by said puncher;

a second size detector for detecting a size of sheet which is not able to be punched appropriately by said puncher;

an instruction input terminal for inputting an instruction for a punching operation of said puncher; and an inhibitor for inhibiting said instruction input terminal from inputting the instruction when the size detected by said first size detector corresponds to the size detected by said second size detector.

23. An image forming apparatus, comprising:

an image forming unit for forming an image on a sheet;

a puncher for punching the sheet carrying the image formed by said image forming unit;

a detector for detecting that a sheet is not able to be punched appropriately by said puncher; and an alarm for indicating an alarm in accordance with a detecting result by said detector.

24. An image forming apparatus according to claim 23, further comprising:

a first instruction input terminal for inputting a first instruction for an image forming operation of said image forming unit;

an invalidator for invalidating the first instruction inputted from said first instruction input terminal in accordance with the detecting result by said detector, wherein said image forming unit forms an image in accordance with the first instruction unless said invalidator invalidates the instruction.

25. An image forming apparatus according to claim 24, wherein said invalidator does not invalidate the first instruction secondarily inputted from said first instruction input terminal despite the detecting result by said detector.

26. An image forming apparatus according to claim 25, further comprising:

a second instruction input terminal for inputting a second instruction for a punching operation of said puncher, wherein said puncher punches the sheet in accordance with the second instruction and said invalidator invalidates the second instruction when said image forming unit starts an image forming operation in accordance with the first instruction secondarily inputted from first instruction input signal.

27. An image forming apparatus, comprising:

an image forming unit for forming an image on a sheet;

a puncher for punching the sheet carrying the image formed by said image forming unit;

a detector for detecting that a sheet is not able to be punched appropriately by said puncher;

an instruction input terminal for inputting an instruction for an image forming operation of said image forming unit; and an invalidator for invalidating the instruction inputted from said instruction input terminal in accordance with a detecting result by said detector, wherein said image forming unit forms an image in accordance with the instruction unless said invalidator invalidates the instruction.

28. An image forming apparatus, comprising:

an image forming unit for forming an image on a sheet;

a puncher for punching the sheet carrying the image formed by said image forming unit;

a detector for detecting that a sheet is not able to be punched appropriately by said puncher;

an instruction input terminal for inputting an instruction for a punching operation of said puncher; and an invalidator for invalidating the instruction inputted from said instruction input terminal in accordance with a detecting result by said detector.

29. An image forming apparatus, comprising:

an image forming unit for forming an image on a sheet;

a puncher for punching the sheet carrying the image formed by said image forming unit;

a detector for detecting that a sheet is not able to be punched appropriately by said puncher;

an instruction input terminal for inputting an instruction for a punching operation of said puncher; and an inhibitor for inhibiting said instruction input terminal from inputting the instruction in accordance with a detecting result by said detector.

30. An image forming method, comprising the steps of:

forming an image on a sheet;

punching the sheet carrying the image formed by said image forming means;

detecting a dimension of the sheet;

determining, based on the sheet dimension detected and a distance between an outermost holes of a row of holes to be punched, whether positions of the holes to be punched fall within the dimension of said sheet; and interrupting a start of an image forming operation when it is determined that the positions of the holes to be punched fall outside of the dimension of said sheet.

31. An image forming method according to claim 30, further comprising the steps of:

setting up a punching unit to perform a punching operation; and disabling the setting up of the punching unit and for allowing image formation to start when an image forming instruction is received after image forming operation has been interrupted.

32. An image forming method according to claim 30, wherein said punching step comprises one of a duplex punching of two holes and triplet punching of three holes, a distance between outermost holes to be punched by said triplet punching being different from a distance between the two holes to be punched by said duplex punching and wherein a determination in accordance with a signal corresponding to the punching step and indicating whether said punching step comprises the duplex punching or the triplet punching.

33. An image forming method according to claim 30, wherein said determination is based on a signal corresponding to the punching step and indicating the minimum dimension of a sheet that permits punching.

34. An image forming method according to claim 30, wherein said determination is in accordance with manually-input sheet size information.

35. An image forming method, comprising the steps of:

forming an image on a sheet;

punching holes in the sheet carrying the formed image;

setup of punching means to enable the punching means to perform a punching operation;

detecting a dimension of the sheet;

determining, based on the sheet dimension detected and on a distance between outermost holes of a row of holes to be punched by the punching means, whether positions of the holes to be punched fall outside of the dimension of said sheet; and inhibiting the punching setup step from performing a setup operation when said determination is made that the positions of the holes to be punched fall within the dimension of said sheet.

36. An image forming method, comprising the steps of:

forming an image on a sheet;

punching the sheet carrying the image formed by said image forming means;

detecting a dimension of said sheet;

determining, based on the sheet dimension detected and on a distance between outermost holes of a row of holes to be punched, whether positions of the holes to be punched fall within the dimension of said sheet; and issuing a warning when there is a determination that the position of at least one of the holes to be punched falls outside the dimension of said sheet.

37. An image forming method according to claim 36, wherein said determination is based on a nominal size of the sheet.

38. An image forming method according to claim 36, wherein said determination is based on the number of holes to be punched in said punching step.

39. An image forming method according to claim 36, wherein said punching step comprises one of duplex punching of two holes and triplet punching of three holes, and wherein a distance between outermost holes to be punched in said triplet punching is different from a distance between the two holes to be punched in said duplex punching.

40. An image forming method according to claim 36, further comprising the steps of:

controlling the punching so as to prohibit punching when a determination is made that the positions of the holes to be punched do not fall within the dimension of said sheet.

41. An image forming method, comprising the steps of:

forming an image on a sheet;

punching the sheet carrying the image formed;

detecting a first size of sheet to be punched;

detecting a second size of sheet which is not able to be punched appropriately; and providing an alarm when the first size detected corresponds to the second size detected.

42. An image forming method according to claim 41, further comprising:

inputting a first instruction for an image forming operation; and invalidating the first instruction inputted when the first size detected corresponds to the second size detected, wherein said image formation is in accordance with the first instruction unless said invalidator invalidates the instruction.

43. An image forming method according to claim 41, wherein said second size detection detects the size based on information about a puncher.

44. An image forming method according to claim 42, wherein said invalidating does not invalidate the first instruction secondarily inputted even if the first size detected corresponds to the second size detected.

45. An image forming method according to claim 42, wherein said alarm is provided when the first size detected is unknown.

46. An image forming method according to claim 44, further comprising the steps of:

inputting a second instruction for a punching operation, wherein said punching operation is in accordance with the second instruction and the second instruction is invalidated when said image forming operation is in accordance with the first instruction.

47. An image forming method according to claim 45, further comprising the steps of:

inputting an instruction for an image forming operation; and invalidating the instruction inputted when the first size detected is unknown, wherein said image is formed in accordance with the instruction unless the instruction is invalidated.

48. An image forming method according to claim 47, wherein the instruction secondarily inputted is not invalidated even if the size detected by said first size detector is unknown.

49. An image forming method, comprising the steps of:

forming an image on a sheet;

punching the sheet carrying the image formed;

detecting a first size of a sheet to be punched;

detecting a size of sheet which is not able to be punched appropriately;

inputting an instruction for an image forming operation; and invalidating the instruction inputted when the first size detected corresponds to the second size detected, wherein said image is formed in accordance with the instruction unless the instruction is invalidated.

50. An image forming method, comprising the steps of:

forming an image on a sheet;

punching the sheet carrying the image formed;

detecting a first size of sheet to be punched;

detecting a second size of sheet which is not able to be punched appropriately;

inputting an instruction for a punching operation; and invalidating the instruction inputted when the first size detected corresponds to the second size detected.

51. An image forming method, comprising the steps of:

forming an image on a sheet;

punching the sheet carrying the image formed;

detecting a first size of sheet to be punched;

detecting a second size of sheet which is not able to be punched appropriately;

inputting an instruction for a punching operation; and inhibiting said instruction input when the first size detected corresponds to the second size detected.

52. An image forming method, comprising the steps of:

forming an image on a sheet;

punching the sheet carrying the image formed;

detecting that a sheet is not able to be punched appropriately; and sounding an alarm in accordance with a detecting result.

53. An image forming method according to claim 52, further comprising:

inputting a first instruction for an image forming operation; and invalidating the first instruction inputted in accordance with the detecting result, wherein said image in accordance with the first instruction unless said instruction is invalidated.

54. An image forming method according to claim 53, wherein said invalidating does not invalidate the first instruction despite a detecting result.

55. An image forming method according to claim 54, further comprising the steps of:

inputting a second instruction for a punching operation, wherein said punching operation punches the sheet in accordance with the second instruction and said invalidating step invalidates the second instruction when said image forming unit starts an image forming operation in accordance with the first instruction.

56. An image forming method, comprising the steps of:

forming an image on a sheet;

punching the sheet carrying the image formed;

detecting that a sheet is not able to be punched appropriately;

inputting an instruction for an image forming operation; and invalidating the instruction inputted in accordance with a detecting result, wherein the image forming operation is in accordance with the instruction unless invalidated in the invalidating step.

57. An image forming method, comprising the steps of:

forming an image on a sheet;

punching the sheet carrying the image formed;

detecting that a sheet is not able to be punched appropriately;

inputting an instruction for a punching operation; and invalidating the instruction inputted in accordance with a detecting result.

58. An image forming method, comprising the steps of:

forming an image on a sheet;

punching the sheet carrying the image formed;

detecting that a sheet is not able to be punched appropriately;

inputting an instruction for a punching operation; and inhibiting input of the instruction in accordance with a detecting result.

* * * * *

UNITED STATES PATENT AND TRADEMARK OFFICE

CERTIFICATE OF CORRECTION

PATENT NO. : 6,325,585 B1
DATED : December 4, 2001
INVENTOR(S) : Ichiro Sasaki et al.

It is certified that error appears in the above-identified patent and that said Letters Patent is hereby corrected as shown below:

Column 10,
Line 36, “sheet which is not” should read -- sheet to be punched by said puncher; ¶ --.
Line 37, “able to be” should read -- second size detector for detecting a size of sheet which is not able to be --.

Column 13,
Line 51, “instruction.” should read -- instruction inputted secondarily. --.

Signed and Sealed this

Twenty-seventh Day of August, 2002

*Attest:*

*Attesting Officer*

JAMES E. ROGAN
*Director of the United States Patent and Trademark Office*